US006075510A

United States Patent [19]

Blouin et al.

[11] Patent Number: 6,075,510

[45] Date of Patent: Jun. 13, 2000

[54] LOW POWER REFRESHING (SMART DISPLAY MULTIPLEXING)

[75] Inventors: Francois Blouin; Guillaume Comeau, both of Hull, Canada

[73] Assignee: Nortel Networks Corporation, Montreal, Canada

[21] Appl. No.: 08/959,007

[22] Filed: Oct. 28, 1997

[51] Int. Cl.[7] ..... G09G 3/36

[52] U.S. Cl. ..... 345/99; 345/94; 345/213

[58] Field of Search ..... 345/87, 89, 92, 345/94, 98, 99, 100, 213

[56] References Cited

U.S. PATENT DOCUMENTS

| | | | |
|---|---|---|---|
| 4,748,444 | 5/1988 | Arai | 345/99 |
| 5,166,670 | 11/1992 | Takeda et al. | 345/100 |
| 5,394,166 | 2/1995 | Shimada | 345/98 |
| 5,448,260 | 9/1995 | Zenda et al. | 345/100 |
| 5,477,234 | 12/1995 | Suzuki et al. | 345/95 |
| 5,500,653 | 3/1996 | Kamihata | 345/98 |
| 5,598,565 | 1/1997 | Reinhardt | 713/323 |
| 5,867,140 | 2/1999 | Rader | 345/98 |
| 5,881,299 | 3/1999 | Nomura et al. | 713/324 |
| 5,926,173 | 7/1999 | Moon . | |

FOREIGN PATENT DOCUMENTS

| | | |
|---|---|---|
| 0651367 | 5/1995 | European Pat. Off. . |
| 0725380 | 8/1996 | European Pat. Off. . |
| WO9641253 | 12/1996 | WIPO . |

*Primary Examiner*—Kent Chang

[57] ABSTRACT

A reduced-power method of updating an LCD display. LCD displays are refreshed line by line. Lines of the display which do not need to be updated, i.e. which are blank, are refreshed with less power than lines which require updating. This is achieved by latching display data to the blank lines for only a very short period of time.

19 Claims, 6 Drawing Sheets

| pixel | value | pixel | value | pixel | value |
|---|---|---|---|---|---|
| 1a | 1 | 2a | 0 | 3a | 0 |
| 1b | 0 | 2b | 1 | 3b | 0 |
| 1c | 1 | 2c | 0 | 3c | 0 |

| pixel | value | pixel | value | pixel | value |
|---|---|---|---|---|---|
| 1a | 1 | 2a | n/a | 3a | n/a |
| 1b | 0 | 2b | n/a | 3b | n/a |
| 1c | 1 | 2c | n/a | 3c | n/a |

LOW POWER REFRESHING (SMART DISPLAY MULTIPLEXING)

FIELD OF THE INVENTION

The invention relates to low power consumption liquid crystal controllers and displays and to methods of reducing power consumption in liquid crystal displays.

BACKGROUND OF THE INVENTION

LCDs (liquid crystal displays) are commonly used in portable devices which are battery operated. By reducing the battery consumption of such displays, the portable devices may be used for longer periods of time before a recharge or battery change is required.

It is often desirable to have only a portion of an LCD active to minimize power consumption. This occurs when a system is in a state where it is known that only some LCD lines need to be refreshed. One common example is a wireless phone in standby mode where only some icons near the top of the screen need to be turned on. In most existing systems, the whole screen is powered all the time, resulting in mediocre power efficiency. Alternatively, two separate controllers can be used on the same LCD, one dedicated to icons and one dedicated to the main display area. This solution results in additional cost, weight and space.

Several additional methods have been recently developed for decreasing the power required for LCD operation. In PCT application WO 96/41253 by S. Ho, published Dec. 19, 1996 and entitled "Power Down Mode for Computer System", power consumption is reduced by shutting down the LCD controller. However, the LCD module itself is always running at full power and at full multiplexing. This particular implementation is only applicable to a special kind of driver integrated circuit which has built in RAM. These drivers are not standard nor widely used because of their expensive price.

European patent application 0 651 367 by K. Kaeko published May 3, 1995 and entitled "Arrangement for Reducing Power Consumption in a Matrix Display Based on Image Change Detection" discloses an LCD in which power consumption is reduced by reducing the contrast level (voltage) of the image. This is an obvious way to reduce display power consumption and probably the least efficient way since the display legibility is reduced as well.

European patent application 0 725 380 by E. Matsuzaki et al. published Aug. 7, 1996 and entitled "Display Control Method for Display Apparatus Having Maintainability of Display-status Function and Display Control System" discloses a system applicable to display devices which are bistable, i.e. displays having a memory effect. This kind of display does not need to be refreshed every frame. Ferroelectric LCDs are one type of displays incorporating this effect. With this method, only portions of the display are rewritten, namely those which have changed. The remaining portions are still on and retain their previous display values. This is not applicable to passive displays which have no memory.

SUMMARY OF THE INVENTION

It is an object of the invention to obviate or mitigate one or more of the above identified disadvantages.

According to a first broad aspect, the invention provides a method of reducing power consumption in a liquid crystal display in which it is known that certain lines are active and certain lines are inactive, the method comprising the steps of: for each active line, latching display data to the line for a period sufficient to develop an acceptable visible display; and for each inactive line, latching display data to the line for a period insufficient to develop a visible display.

According to a second broad aspect, the invention provides a liquid crystal display controller for controlling a liquid crystal display, and for producing a LATCH output signal, a DATA output signal, and a CLOCK output signal, wherein rows of data are output on the DATA output signal synchronously with the CLOCK output signal, after each row is output a LATCH output signal is sent, when one or more rows is to be skipped no data is output for that row(s) but rather data is output for the next row requiring refreshing, after this next row is output a plurality of Latch pulses are sent in rapid succession, the plurality comprising one for each row to be skipped and one for the row requiring refreshing.

According to a third broad aspect, the invention provides a liquid crystal display apparatus comprising: a liquid crystal display glass having a plurality of rows of pixels including a first row; a shift register for holding a single row of pixel data; a row selector for selecting which row of the display glass is to be refreshed; a display controller; wherein the display controller refreshes the display glass by sending a row of pixel data to the shift register and then sending a first latch pulse to latch the contents of the shift register to the display glass to the row selected by the row selector, the latch pulse also causing the row selected by the row selector to be incremented; wherein the display controller sends a first line marker signal to the row selector to indicate when the first row is to be refreshed; wherein to skip one or more rows, the display controller sends in rapid succession immediately following the first latch an additional latch pulse for each row to be skipped.

BRIEF DESCRIPTION OF THE DRAWINGS

Preferred embodiments of the invention will now be described with reference to the attached drawings in which.

DETAILED DESCRIPTION OF THE PREFERRED EMBODIMENTS

Figure 1:
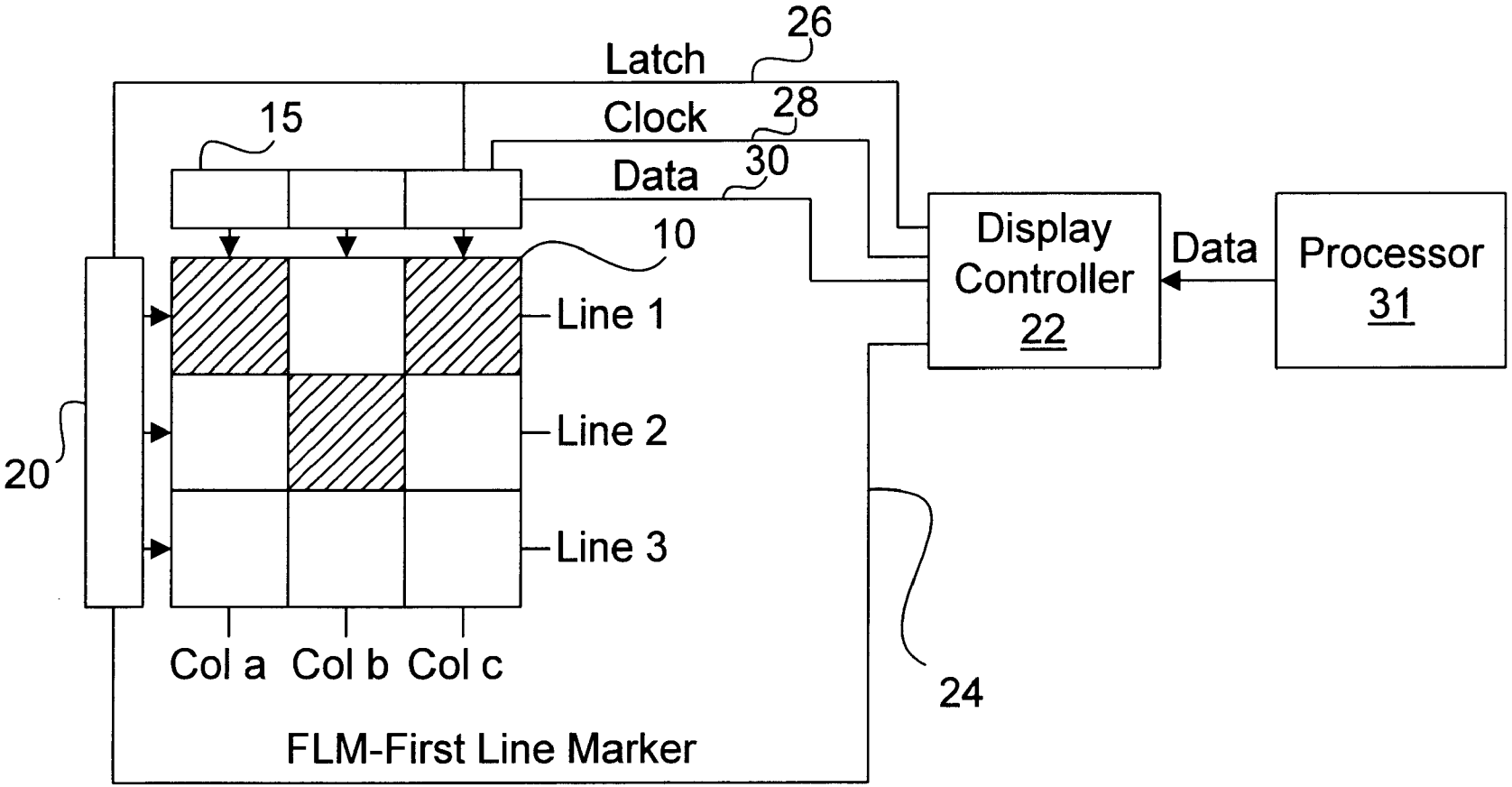
FIG. 1 PRIOR ART
FIG. 1 is block diagram of a conventional LCD display apparatus.

Referring firstly to FIG. 1, a conventional LCD display includes a display glass with an LCD pixel matrix 10 consisting of vertical columns and horizontal rows or lines of pixels. In the illustrated example the pixel matrix 10 is a 3×3 matrix having three lines namely line 1, line 2, and line 3, and three columns namely columns a, column b, and column c. A shift register 15 is provided for storing pixel voltages for a single line of pixels. A line selector 20 is provided for selecting a particular row of pixels. A display controller 22 is connected to both the line selector 20 and the shift register 15 so as to send a periodic vertical synchronization signal (FLM—first line marker) 24 to the line selector 20, a periodic horizontal synchronization signal (LATCH) 26 comprising a series of LATCH pulses to both the shift register 15 and the line selector 20, a clock signal (CLOCK) 28 to the shift register, and a data signal (DATA) 30 to the shift register.

It is assumed that some external system, for example software running on a processor 31 is generating the raw data to be displayed on the LCD display 10.

Figure 2A:
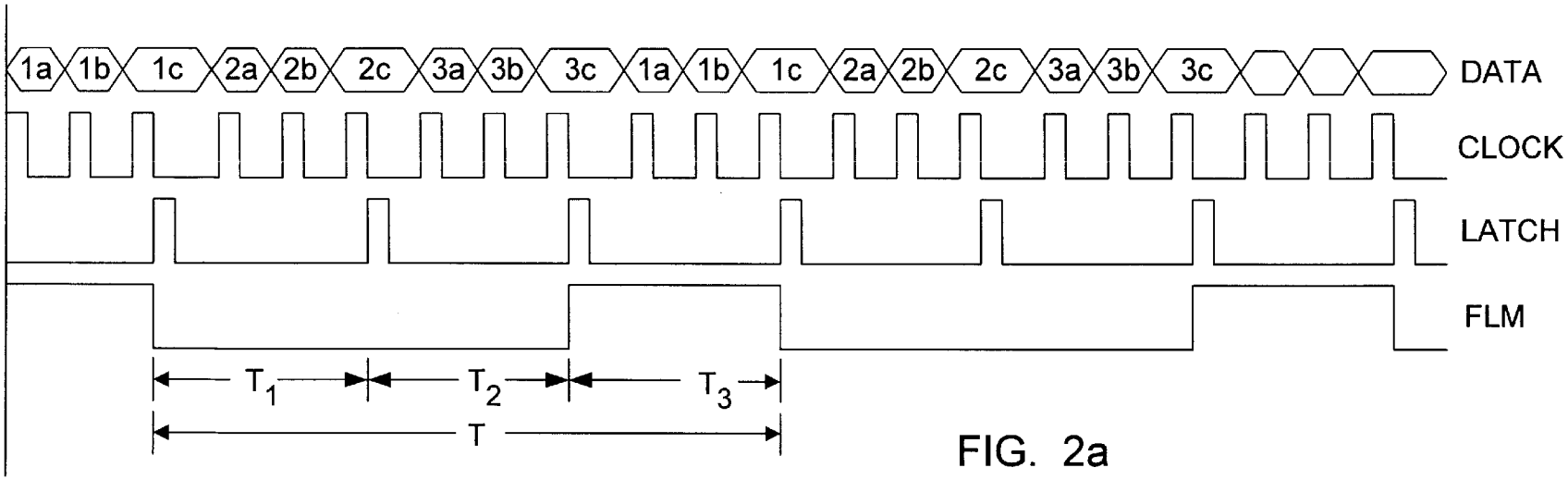
FIG. 2a PRIOR ART
FIG. 2*a* is timing diagram for signals produced by the conventional display controller of FIG. 1.
Figure 2B:
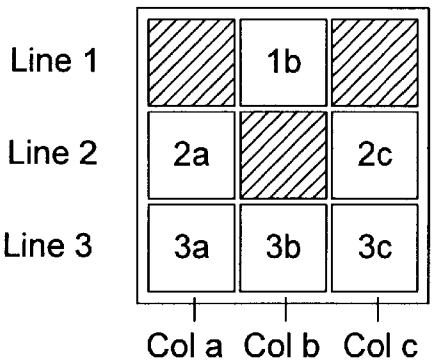
FIG. 2b PRIOR ART
FIG. 2*b* is an example display produced by the control signals of FIG. 2*a* together with a table of pixel values.

The conventional operation of the display of FIG. 1 will be described by way of example with reference to FIGS. 2*a* and 2*b*. FIG. 2*a* shows how the DATA, CLOCK, LATCH, and FLM signals are used to control the refreshing of the display. To begin, the display controller 22 loads three bits 1*a*,1*b*,1*c* into the shift register 15 with the DATA signal 30, one bit for each of three pulses of the CLOCK signal. Next a falling edge of the FLM signal (which must have been preceded at some point by a rising edge) indicates that the data is to be latched to the first line in the display glass. Next, a LATCH pulse is sent the falling edge of which latches the current shift register contents to the pixel matrix 10. Next, bits 2*a*,2*b*,2*c* are loaded into the shift register 15 and latched to the display with a second LATCH pulse to the next row in the display as determined by the line selector 20 which increments its selected line each time a LATCH pulse is received. In this case bits 2*a*,2*b*,2*c* are latched to the second line of the display. The period between the clock pulses in differing rows (bits 1*c*,2*a* for example) is larger than the period between consecutive bits in the same row (bits 1*a*,1*b* for example) to allow the latch signal to be sent. Similarly bits 3*a*,3*b*,3*c* are loaded into the shift register and latched to the third line of the display with a third LATCH pulse. This sequence of events is then repeated continuously. The time it takes to refresh the entire display is the "scan period" or "frame period". This is indicated by the interval "T" shown in FIG. 2*a*. FIG. 2*b* shows a chart of the contents of an example DATA signal and the resulting pixel display where a dark pixel is displayed for a pixel value of one, and a clear pixel is displayed for a pixel value of zero.

With the conventional system described above, only one LCD line is refreshed at a time. Assuming there are N lines, each of the N lines is active for one Nth of the scan period. In the example illustrated in FIG. 2*a*, $T_1$,$T_2$, and $T_3$ are the periods during which each of the three lines are active, and each of these three periods is equal to ⅓×T, T being the scan period. When a line is active, it receives energy from the LCD drivers (not shown). The total power consumed by the display may be summarized as follows:

$$P = \sum_{i=1}^{i=N} P_i \tag{1}$$

$$P_i = (VI)\frac{T_i}{T} = (VI)\frac{1}{N} = \text{constant}$$

where

P=total LCD power consumption;

N=number of LCD lines;

V=operating voltage;

I=driving current;

T=frame period;

$T_i$=active period of the ith line; and $P_i$=power consumption of the ith line.

From the above it can be seen that the amount of energy expended per row is proportional to $T_i$. If $T_i$ can be reduced for inactive rows, then a more efficient driving method will result. For the example of FIG. 2, all of the pixels in the third row are off; thus, if $T_3$ can be reduced, this would result in a power savings.

According to an embodiment of the invention, an LCD controller is provided for refreshing a subset of the lines and for skipping over other lines which are known to be inactive.

Figure 3:
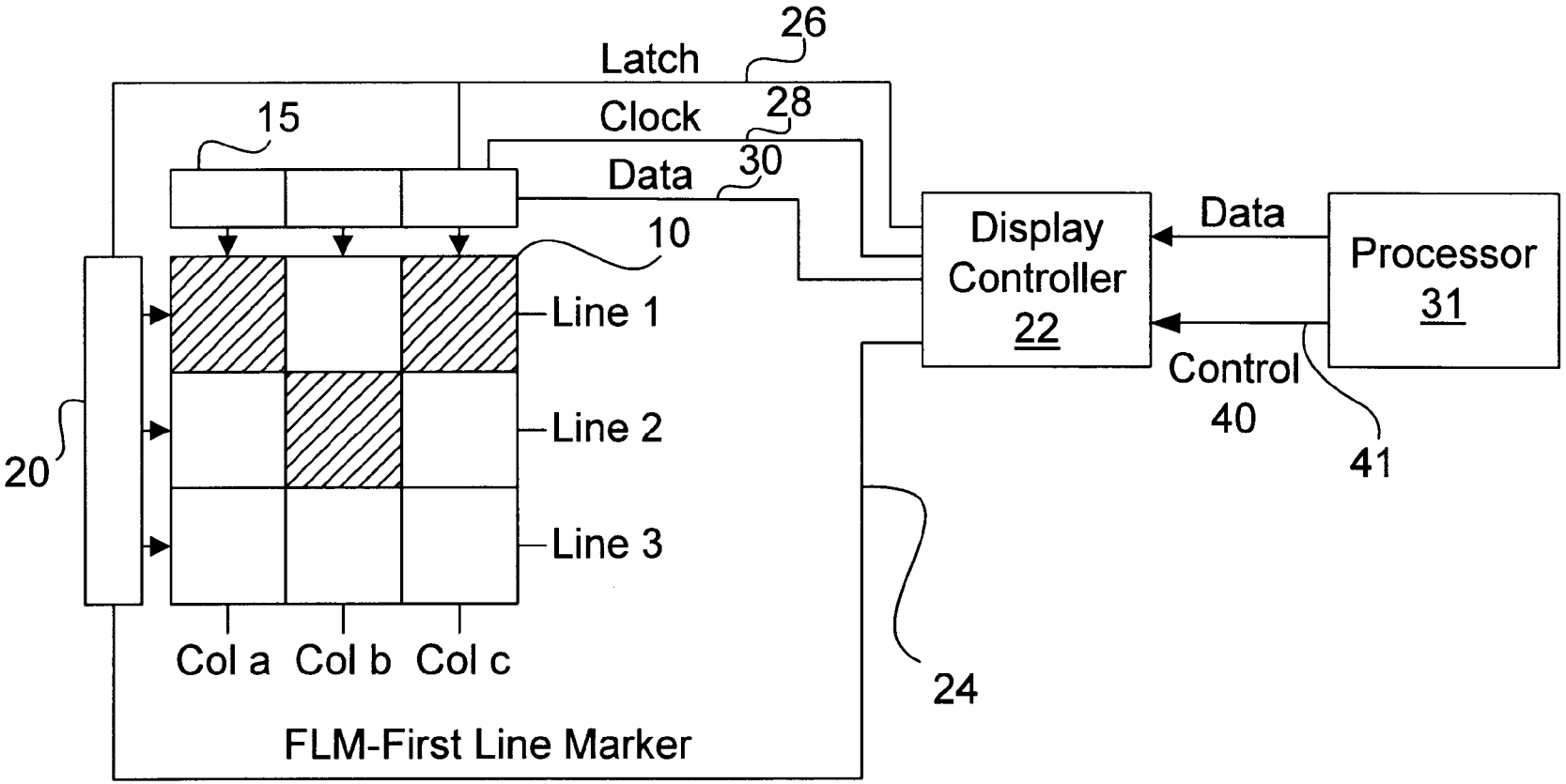
FIG. 3 is a block diagram of an LCD display apparatus according to an embodiment of the invention.

An LCD display apparatus according to an embodiment of the invention is shown in FIG. 3. This differs from the apparatus of FIG. 1 in that there is a control signal 40 passed along a control line 41 extending between the processor 31 and the display controller 22, and in that the display controller 22 operates differently, as described in detail below.

Figure 4:
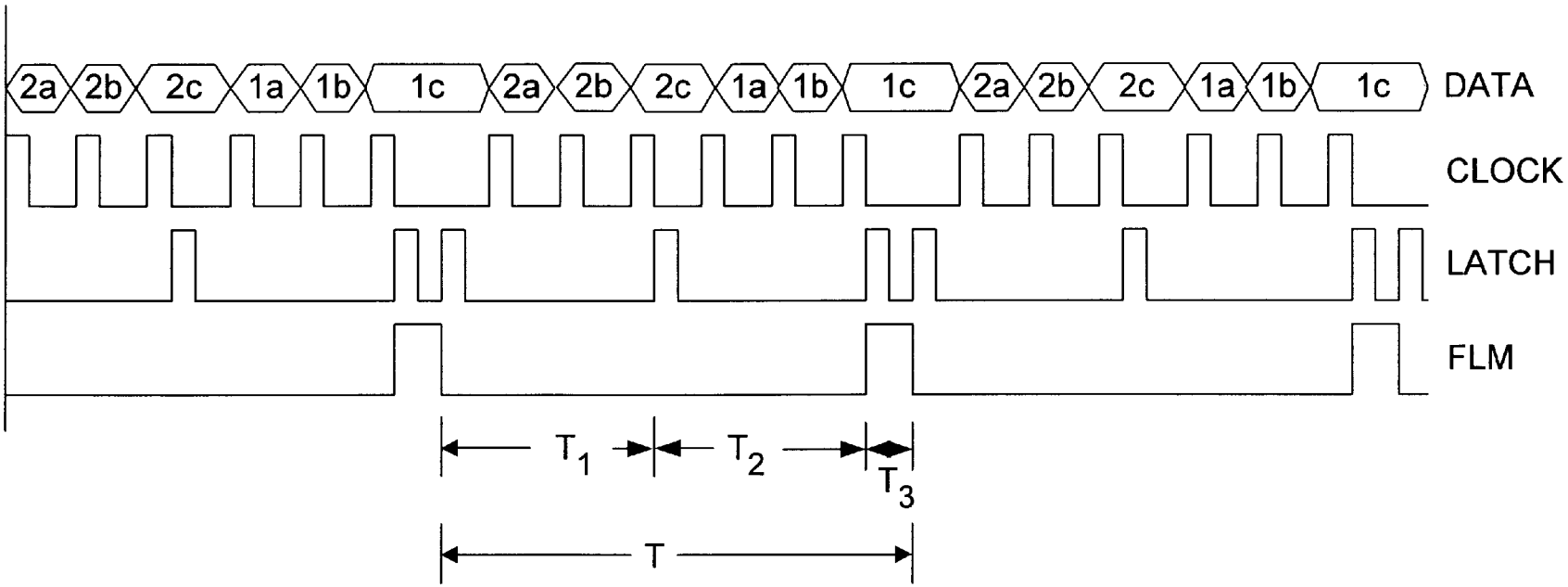
FIG. 4 is an example of a set of control signals produced by the display controller of FIG. 3.

In order to skip a line the LCD controller sends a double latch signal consisting of a first LATCH pulse very shortly thereafter followed by a second LATCH pulse. The brief period between the two latch pulses serves to drive the inactive line but for such a short period of time that no display will result. This will be described now further with reference to the example of FIG. 4. In this example it is assumed that the same sample pixel values are to be displayed as were described previously with reference to FIGS. 2*a* and 2*b*. In this example, the signal diagram of FIG. 4 starts with the loading of the data in line 2. The data signal contains the bits 2*a*, 2*b*, and 2*c* which are loaded into the shift register synchronous with three CLOCK signals. Following this a LATCH pulse causes the data to be latched on to the second line of the pixel matrix. Next three data bits labelled 1*a*, 1*b* and 1*c* are loaded into the shift register. A first LATCH pulse causes these to be displayed to the third line, and a second LATCH pulse causes the same data to be displayed to the first line. However, the period during which the third line is active is such a short time that no visible display results. A falling edge of the FLM signal is sent simultaneously with the second LATCH pulse and indicates that the next row to be displayed is to be the first row. In this example, the two active lines, namely line 1 and line 2 each receive about one half of the energy of the frame with a small amount being expended on line 3. This can be seen by comparing the times during which each line is active. $T_1$ and $T_2$ are equal and approximately half of T while $T_3$ is very short, being equal to the period from the end of the first LATCH pulse to the end of the second LATCH pulse.

In the case that a larger display is being used and additional lines are to be skipped, additional LATCH pulses are generated, one for each additional line to be skipped. It is noted that the CLOCK signal must consist of CLOCK pulses sent between the LATCH pulse and that when more than one LATCH pulse is being sent so as to result in a line being skipped, the display controller must accommodate this by delaying the CLOCK pulses for the next row by the period of the extra LATCH pulses.

The control signal 40 is used by the processor 31 to inform the display controller 22 which lines if any are to be skipped.

Figure 5A:
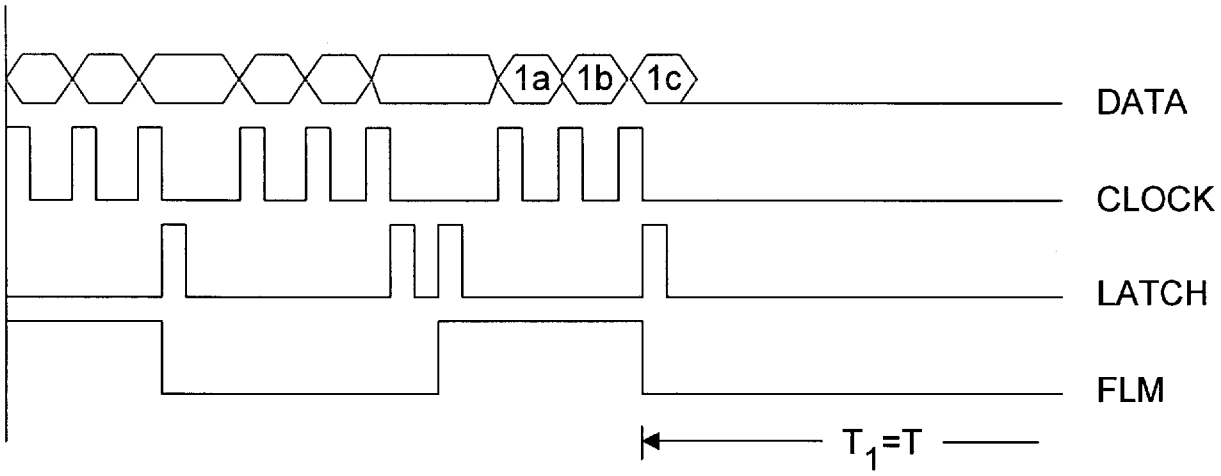
FIG. 5*a* is an example of a set of control signals produced by a display controller according to another embodiment of the invention.
Figure 5B:
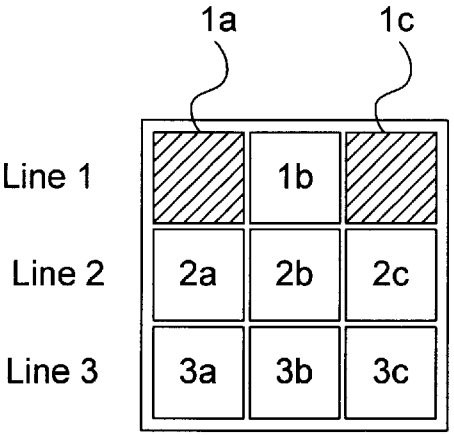
FIG. 5*b* is an example display produced by the control signals of FIG. 5*a* together with a table of pixel values.

Turning now to FIGS. 5*a*, 5*b* a second embodiment of the invention will be described. The control signals are shown in FIG. 5*a* and a resulting display and pixel values are shown in FIG. 5*b*. This embodiment is for use in displays in which it is known that only a single line of pixels is active during a certain mode of operation. This might consist of pixel icons on a mobile telephone display for example. In this example, again the three pixels 1*a,* 1*b,* and 1*c* are loaded into the shift register under control of the clock signal and latched to the display in the first row synchronous with an FLM signal falling edge. Following this the controller then drives all the control signals low. This results in stalling the LCD drivers on the only active line which in turn receives all of the energy.

In a third embodiment of the invention, assuming that only a contiguous portion at the top of the LCD display is to be driven, the FLM signal may be used after all the active lines have been displayed to cause the line selector to skip back to the first line. It was surprisingly noted during testing that in some LCD displays this technique may cause replicate images to be displayed in the inactive portion of the LCD display. This seems to be due to the fact that the LCD drivers of these displays are built to expect all of the lines to be refreshed every scan interval. This method is not appropriate for displays which produce such replicate images.

In any of the embodiments, by skipping inactive lines ($T_i$ inactive approaching 0) the total frame period T is caused to decrease. At the same time, the refresh ratio $T_i/T$ of the active lines increases. Recalling from equation (1) above that the power consumption of the ith line is proportional to the refresh ratio, since the refresh ratio is increased by skipping inactive lines, the power can be maintained constant by decreasing the operating voltage or driving current accordingly. As a result, the total power consumption of the LCD in the power reduced mode is approximately the normal LCD power multiplied by the ratio of the number of active lines over the total number of lines.

Numerous modifications and variations of the present invention are possible in light of the above teachings. It is therefore to be understood that within the scope of the appended claims, the invention may be practised otherwise than as specifically described herein.

In the above described embodiment, it is assumed that a signal from an external source (such as a microprocessor) informs the display controller when lines are to be skipped.

It may be that software running on an external processor has a user interface through which a user of the software may select the display mode to be either "succinct" or "verbose" in response to which appropriate line skipping commands are sent to the display controller. The software may also modify the contents what it displays according to the mode selected by the user. In "succinct" mode, the software generates a smaller amount of display information which can fit on a reduced portion of the display, while in "verbose" mode, the software generates its normal amount of display information which requires the use of the entire portion of the display.

Figure 6B:
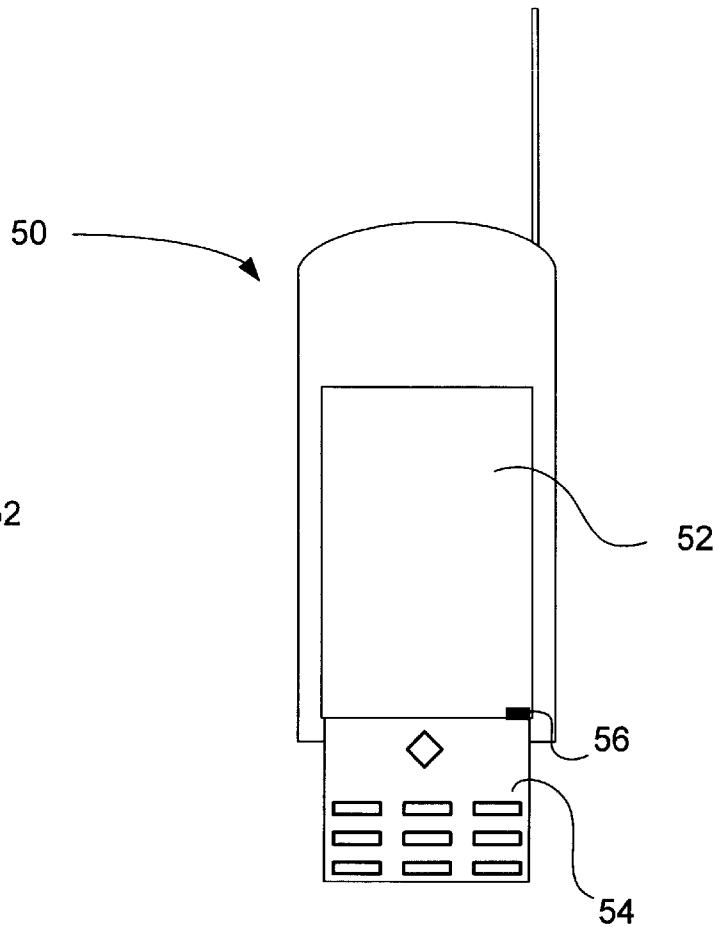
FIGS. 6*a* and 6*b* show an example of a display according to an embodiment of the invention for application in a mobile cellular telephone with a sliding keypad.
Figure 6A:
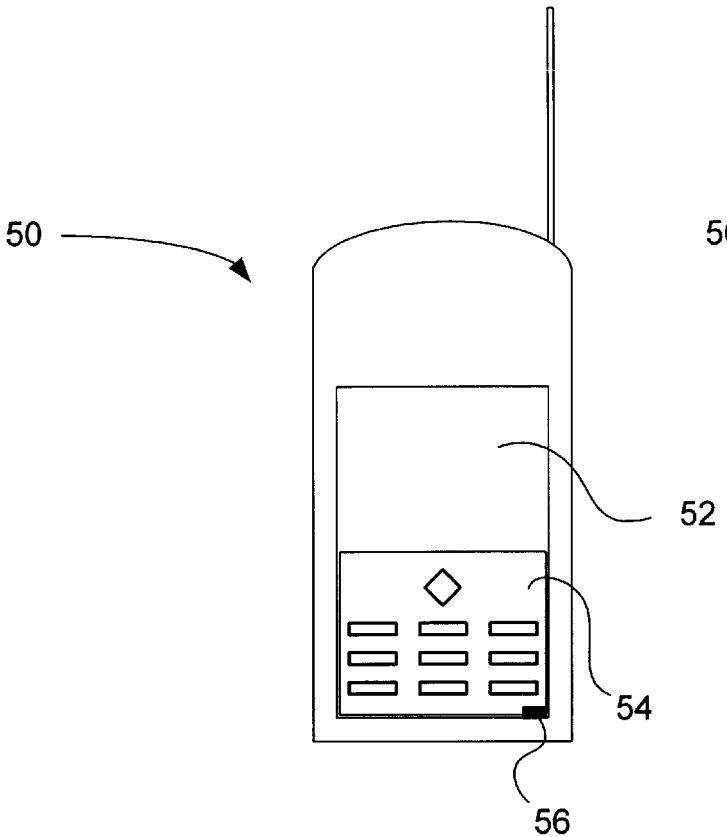

Referring now to FIGS. 6*a* and 6*b,* an example of an LCD display according to an embodiment of the invention forming part of a mobile cellular telephone is shown, although it is to be understood that such a display may find application in other devices. The mobile cellular telephone is generally indicated by 50 and is equipped with a LCD display 52 and a sliding keypad 54 which may be used in one of two positions. In FIG. 6*a,* the keypad 54 is shown in a closed position in which it covers a portion of the LCD display 52. In FIG. 6*b,* the keypad 54 is shown in its open position in which the entirety of the LCD display 52 is exposed. In this example, it would be known at the time of the design that a portion of the LCD display 52 is covered when the keypad 54 is closed. A sensor 56 may be used to determine whether the keypad is opened or not, and the output of the sensor used by the controller to determine the behaviour of the display according to the following table:

| sensor output | LCD upper half | LCD lower half |
|---|---|---|
| closed | active | skipped |
| opened | active | active |

This is an example where prior design knowledge has been used to configure the controller. Of course, more generally the sensor may produce a sensor output signal having a plurality of possible states upon which the controller determines which lines of the display to activate and which lines of the display to skip.

Alternatively, the display controller may be equipped with the intelligence to make the decision of which lines to skip itself. For example, it may be equipped to examine display data so as to be able to tell when the display data for a line is zero for consecutive scan periods. It could then skip this line for subsequent scan periods until the display data becomes non-zero.

While in the illustrated embodiment, a display controller has been described which is a separate physical entity from the ultimate source of the display data, it may alternatively be implemented as a software display controller which may or may not be integrated with the ultimate source of the display data.

The embodiments of the invention in which an exclusive property or privilege is claimed are defined as follows:

1. A method of reducing power consumption in a liquid crystal display in which it is known that certain lines are active and certain lines are inactive, the method comprising the steps of:

for each active line, latching display data to the line for a first period sufficient to develop an acceptable visible display; and for each inactive line, latching display data to the line for a second period insufficient to develop a visible display the second period being shorter than the first period.

2. A method of reducing power consumption in a liquid crystal display in which it is known that certain lines are active and certain lines are inactive, the method comprising the steps of:

for each active line, latching display data to the line for a period sufficient to develop an acceptable visible display; and for each inactive line, latching display data to the line for a period insufficient to develop a visible display;

wherein a display controller is connected to the LCD, the display controller sending a latch pulse to the display each time a new line is to be refreshed, and the display controller sending two latch pulses in rapid succession to skip an inactive line.

3. A method according to claim 2 wherein the lines of the display include a first line, the method further comprising the step of the display controller sending a first line marker signal to indicate that the first line is to be refreshed.

4. A method according to claim 3 wherein when a contiguous block of lines at the bottom of the display is to be skipped, the display controller sends a first line marker synchronously with the latch of the first row of the contiguous block, thereby skipping the entire block.

5. A method according to claim 1 wherein when only a single line of the display needs refreshing, all display driver signals are driven low after the refresh of that line.

6. A method according to claim 1 wherein lines are refreshed with a refresh voltage, and wherein when lines are to be skipped, the refresh voltage is decreased.

7. A method of reducing power consumption in a liquid crystal display in which it is known that certain lines are active and certain lines are inactive, the method comprising the steps of:

for each active line, latching display data to the line for a period sufficient to develop an acceptable visible display; and for each inactive line, latching display data to the line for a period insufficient to develop a visible display;

wherein lines are refreshed with a refresh voltage, and wherein when lines are to be skipped, the refresh voltage is decreased;

wherein the refresh voltage is decreased by an amount proportional to an increase in the percentage of time spent refreshing active lines which has resulted from decreasing the time spent refreshing inactive lines.

8. A liquid crystal display controller for controlling a liquid crystal display, and for producing a LATCH output signal, a DATA output signal, and a CLOCK output signal, wherein rows of data are output on the DATA output signal synchronously with the CLOCK output signal, after each row is output a LATCH output signal is sent, when one or more rows is to be skipped no data is output for that row(s) but rather data is output for the next row requiring refreshing, after this next row is output a plurality of Latch pulses are sent in rapid succession, the plurality comprising one for each row to be skipped and one for the row requiring refreshing.

9. A display controller according to claim 8 having an FLM output signal which is generated to indicate that a first row of the LCD is to be refreshed.

10. A display controller according to claim 8 having a DATA input signal for receiving data to be displayed from an external source and a control input signal indicating which lines are to be skipped.

11. A display controller according to claim 8 wherein the display controller detects when a particular line has been refreshed with all zeros for consecutive refresh periods and skips the particular line until it is to be refreshed with non-zero data.

12. A display controller according to claim 8 wherein the display controller adjusts a display operating voltage according to the ratio of active lines over the total number of lines.

13. A liquid crystal display apparatus comprising:

a liquid crystal display glass having a plurality of rows of pixels including a first row;

a shift register for holding a single row of pixel data;

a row selector for selecting which row of the display glass is to be refreshed;

a display controller;

wherein the display controller refreshes the display glass by sending a row of pixel data to the shift register and then sending a first latch pulse to latch the contents of the shift register to the display glass to the row selected by the row selector, the latch pulse also causing the row selected by the row selector to be incremented;

wherein the display controller sends a first line marker signal to the row selector to indicate when the first row is to be refreshed;

wherein to skip one or more rows, the display controller sends in rapid succession immediately following the first latch an additional latch pulse for each row to be skipped.

14. An apparatus according to claim 13 further comprising a sensor connected to provide a sensor output signal having a plurality of possible states to the controller;

wherein, depending on the state of the sensor output signal, the controller determines which lines are to be displayed and which lines are to be skipped.

15. A method according to claim 1 wherein:

for each active line, latching display data to the line for a period sufficient to develop an acceptable visible display comprises sending a latch pulse to the display each time a new line is to be refreshed;

for each inactive line, latching display data to the line for a period insufficient to develop a visible display comprises sending two latch pulses in rapid succession to skip an inactive line.

16. A method according to claim 15 wherein the lines of the display include a first line, the method further comprising sending a first line marker signal to indicate that the first line is to be refreshed.

17. A method according to claim 16 further comprising, when a contiguous block of lines at the bottom of the display is to be skipped, sending a first line marker synchronously with the latch of the first row of the contiguous block, thereby skipping the entire block.

18. A mobile cellular telephone adapted to implement a method according to claim 1.

19. A mobile cellular telephone comprising a display controller according to claim 8.

* * * * *